US007267240B2

(12) United States Patent
Maurer et al.

(10) Patent No.: US 7,267,240 B2
(45) Date of Patent: Sep. 11, 2007

(54) METHOD AND DEVICE FOR MAINTAINING A POSITION OF A LOAD SUSPENDED FROM A LIFTING GEAR

(75) Inventors: Peter Maurer, Stein (DE); Peter Schulte, Markt Erlbach (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 11/093,015

(22) Filed: Mar. 29, 2005

(65) Prior Publication Data

US 2005/0224438 A1 Oct. 13, 2005

Related U.S. Application Data

(63) Continuation of application No. PCT/DE03/003181, filed on Sep. 24, 2003.

(30) Foreign Application Priority Data

Sep. 30, 2002 (DE) ..... 102 45 868

(51) Int. Cl.
*B66C 13/06* (2006.01)

(52) U.S. Cl. ..... 212/270; 212/274

(58) Field of Classification Search ..... 212/274, 212/275, 272, 270
See application file for complete search history.

(56) References Cited

U.S. PATENT DOCUMENTS 3,043,444 A * 7/1962 Melton ..... 212/274
3,743,107 A * 7/1973 Verschoof ..... 212/274
3,842,986 A * 10/1974 Hupkes ..... 212/330
4,350,254 A * 9/1982 Noly ..... 212/279
4,883,184 A * 11/1989 Albus ..... 212/274
5,440,476 A * 8/1995 Lefkowitz et al. ..... 700/56
5,585,707 A * 12/1996 Thompson et al. ..... 318/568.2
5,769,250 A * 6/1998 Jussila et al. ..... 212/274
6,126,023 A * 10/2000 Durrant-Whyte et al. ... 212/274
6,345,724 B1 * 2/2002 Masumoto et al. ..... 212/173
6,382,437 B1 * 5/2002 Okada et al. ..... 212/274
6,631,816 B1 * 10/2003 Miyazawa et al. ..... 212/272
6,826,452 B1 * 11/2004 Holland et al. ..... 700/245
7,088,071 B2 * 8/2006 Rodnunsky ..... 318/649

FOREIGN PATENT DOCUMENTS

| | | | |
|---|---|---|---|
| DE | 20 53 590 | A | 5/1972 |
| DE | 100 06 486 | A | 9/2001 |
| EP | 1 055 636 | A | 11/2000 |
| FR | 2 625 186 | A | 6/1989 |
| JP | 01 013395 | A | 1/1989 |
| JP | 2001142173 | * | 11/2001 |

OTHER PUBLICATIONS

Database WPI Section PQ, Week 199404, Derwent Publications Ltd., London, GB; AN 1994-033074 XP002272070 & SU 1 785 993 A (Dolgopolov A G), Jan. 7, 1993.

* cited by examiner

*Primary Examiner*—Thomas J. Brahan
(74) *Attorney, Agent, or Firm*—Henry M. Feiereisen

(57) ABSTRACT

In a method for maintaining a position of a load on a lifting gear, a position of a load, which is suspended from a trolley of a lifting gear via at least four cables, is determined and a swinging motion of the load is counteracted by selectively adjusting the length of at least one of the cables.

13 Claims, 5 Drawing Sheets

20
4
4
3
5
5
2
21
12
12
α
1
23
24

METHOD AND DEVICE FOR MAINTAINING A POSITION OF A LOAD SUSPENDED FROM A LIFTING GEAR

CROSS-REFERENCES TO RELATED APPLICATIONS

This application is a continuation of prior filed copending PCT International application No. PCT/DE2003/003181, filed Sep. 24, 2003, which designated the United States and on which priority is claimed under 35 U.S.C. §120, and which claims the priority of German Patent Application, Serial No. 102 45 868.5, filed Sep. 30, 2002, pursuant to 35 U.S.C. 119(a)-(d).

BACKGROUND OF THE INVENTION

The present invention relates, in general, to a method and device for maintaining a position of a load which may or may not be secured to a load-carrying member, e.g. spreader. In the following description, a reference to "load" generally implies a reference to the load itself or also to the load-carrying member which carries the load.

Nothing in the following discussion of the state of the art is to be construed as an admission of prior art.

When swing of a load takes place, as the load is lifted by a lifting gear, such as a crane, the load may be caused to go out of plumb. In particular, in the case of a crane, a precise and safe cargo transfer is however desired for cost reasons. Therefore, the occurrence of a swinging motion as a result of external interferences such as, e.g., wind or uneven loading of a container, should be compensated.

In the following description, the term "swinging motion" or "swing" will be used in a generic sense and is used synonymously and interchangeably with rotation, wobble and/or skew motion or slewing motion. Swinging motion may also involve a movement about a rotation axis whereby the load is deflected at least once or several times from the rest position to an inversion point before returning to the rest position.

German publication no. DE 100 06 486 A1 describes a crane having a trolley and two drum-type hoisting mechanisms, each having two cable drums and a drive unit. Swing of the load can be compensated only in the travel direction of the trolley.

German publication no. DE 20 535 90 describes a lifting gear for loading containers. The lifting gear has a gripper frame and a hoisting mechanism as well as a control unit and a measuring device. The hoisting mechanism includes three lifting units, whereby each lifting unit has a cable drum and a separate drive. While slanted dispositions of the gripper frame can be eliminated before a container is deposited, a swing of the load cannot be compensated.

Heretofore, conventional lifting gears are unable to counter a swinging motion of a load in relation to an axis of the load. Thus, the prior art fails to address the problem of accurate positioning of a load, especially of maintaining a horizontal disposition of a load. The term "positioning" relates in this context to static loads as well as dynamic loads, i.e. masses undergoing changes in motion.

It would therefore be desirable and advantageous to provide an improved method and device for maintaining a position of a load to obviate prior art shortcomings and to address the problem of load swing, in particular about an axis in lifting direction, so as to realize a precise, quick and safe cargo transfer.

SUMMARY OF THE INVENTION

According to one aspect of the present invention, a method for maintaining a position of a load on a lifting gear includes the steps of determining a position of a load which is suspended from a trolley of a lifting gear via at least four cables, and counteracting a swinging motion of the load by selectively adjusting the length of at least one of the cables.

The present invention resolves prior art problems by supporting the load by at least four cables whose length can individually be controlled and by providing a system for recognizing a position of the load to thereby ascertain a swinging motion with respect to a Cartesian coordinate system with x-coordinate or axis, y-coordinate or axis, and z-coordinate or axis. The zero point of the coordinate system lies, for example, in the load center. As noted above, a swinging motion may also involve a movement about a rotation axis whereby the load is deflected at least once or several times from the rest position to an inversion point before returning to the rest position. One type of swinging motion may involve a movement of a load about the z-axis which in a lifting gear constitutes the lifting axis of the load and which may extend through the load center. A skewing motion involves a swinging of the load about the lifting axis or about an axis in parallel relationship to the lifting axis. Another type of swinging motion involves a deflection of the load from a zero position in y-direction. Still another type of a swinging motion involves a deflection of the load from a zero position in x-direction. In the event the x-direction corresponds to the travel direction of the trolley, the load swings in this direction, when a deflection in x-direction is involved. The term "zero position" relates hereby to the position of the load at static rest. In addition to the swinging motions in the direction of an axis of the Cartesian coordinate system, also other axes may be defined about which the load swings. An example of such other axis involves a swinging motion about the diagonal of a load. Of course, a combination of any of above-mentioned swinging motions is conceivable.

The system for load position recognition may include a camera system and a reflector mounted on the load, whereby the position of the load is determined optically. In addition to optical position recognition, application of acoustic or other types of measuring devices for position recognition, known to the artisan, are, of course, applicable as well. When detecting a swing of the load, countermeasures are triggered which involve a change in length of at least one of the cables. As each of the cable drums has its own drive unit, suitably an electric machine, such as, e.g., an electric motor with pertaining converter, and thus can be individually controlled, it is possible to counteract a swing in at least one direction. As a result, recovery of the desired load position can be realized much faster than would be the case, if the load were allowed to simply continue to swing until the swinging motion ceases. The use of an electric motor as drive unit is advantageous because it is inexpensive, easy to implement and easy to control.

Depending on the gravity of the load and the type of swinging motion, one or two cables may no longer be taut compared to a rest position. In other words, not all cables are subjected to the same forces. Thus, when a slack is recognized as a result of a swinging motion, the pertaining drive unit becomes operational to rotate the cable drum and to thereby shorten the slacking cable so as to make it taut again and thereby accurately position the load. This is true especially when a skew motion is involved. As an alternative, it is also possible to lengthen taut cables during a skew motion in order to maintain the load in correct. Regardless whether a lengthening or shortening of cables is involved, the acceleration of the load is decreased, thereby reducing the swing deflection until reaching zero degree so that the load is at rest again.

The state of a cable, i.e. whether the cable is taut or slack or slightly taut, can be determined by the controller of the electric machine through torque comparison between the electric machines.

In case the gravity of the load lies in the intersection of the diagonals of the load, two diagonally opposite cables are lengthened or shortened.

As a consequence of the arrangement of four cables and the provision of four lifting units that are individually operated, the load can be maintained in a horizontal disposition through change of respective cable lengths during lifting, lowering or occurrence of a swinging motion.

It is further possible to influence the skew angle as a result of a rotational movement about the axis of the lifting unit by changing the length of at least one of the cables in order to neutralize and eliminate the swinging motion. Skew angle is defined here as the rotation angle of the load in axial direction about, e.g., the load gravity center of an elevated load.

According to another aspect of the present invention, a device for maintaining a position of a load on a lifting gear includes a trolley, and a hoisting mechanism having at least four lifting units, each lifting unit provided with a cable drum which receives a cable for connection to a load-carrying member and/or load, and a separate drive unit operatively connected to the cable drum for adjusting a length of the cable.

According to another feature of the present invention, a detection system may be provided for recognizing and controlling a position of the load. Thus, when the load is out of plumb and thus deviates from the zero position or rest position, the detection system is able to initiate countermeasures.

According to another feature of the present invention, the cables may extend between the load and the lifting units at a slant in relation to a lifting direction of the load. In this way, the force effect in the direction of the skew angle can be reinforced to compensate the rotation movement or swinging motion. The term "slant" relates hereby to a trapezoidal attachment of the cables. Suitably, the angle between cable and load in the direction of the load center is greater than 90°.

According to another feature of the present invention, the detection system and the drive units of the lifting units are constructed for automatic operation. As a result, the load position can be precisely ascertained and the swinging motion can be compensated. This is advantageous because the crane operator is not required to position the load and thus is under less stress, on one hand, and several different swinging motions can be compensated, on the other hand, so that the correct load position can be reestablished quickly. Proper positioning of the load is crucial in connection in particular with picking up a load or depositing a load.

According to another feature of the present invention, the drive units may be constructed such that each of the drive units can be controlled and regulated individually. In other words, individual cables can be shortened or lengthened to attain a precise positioning of the load. The term "separate" relates in this context to an independent length adjustment of each of the cables irrespective of the other cables. As a consequence of this separate control, the load can be maintained in a horizontal position at any time during lifting, lowering or during swinging motion.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
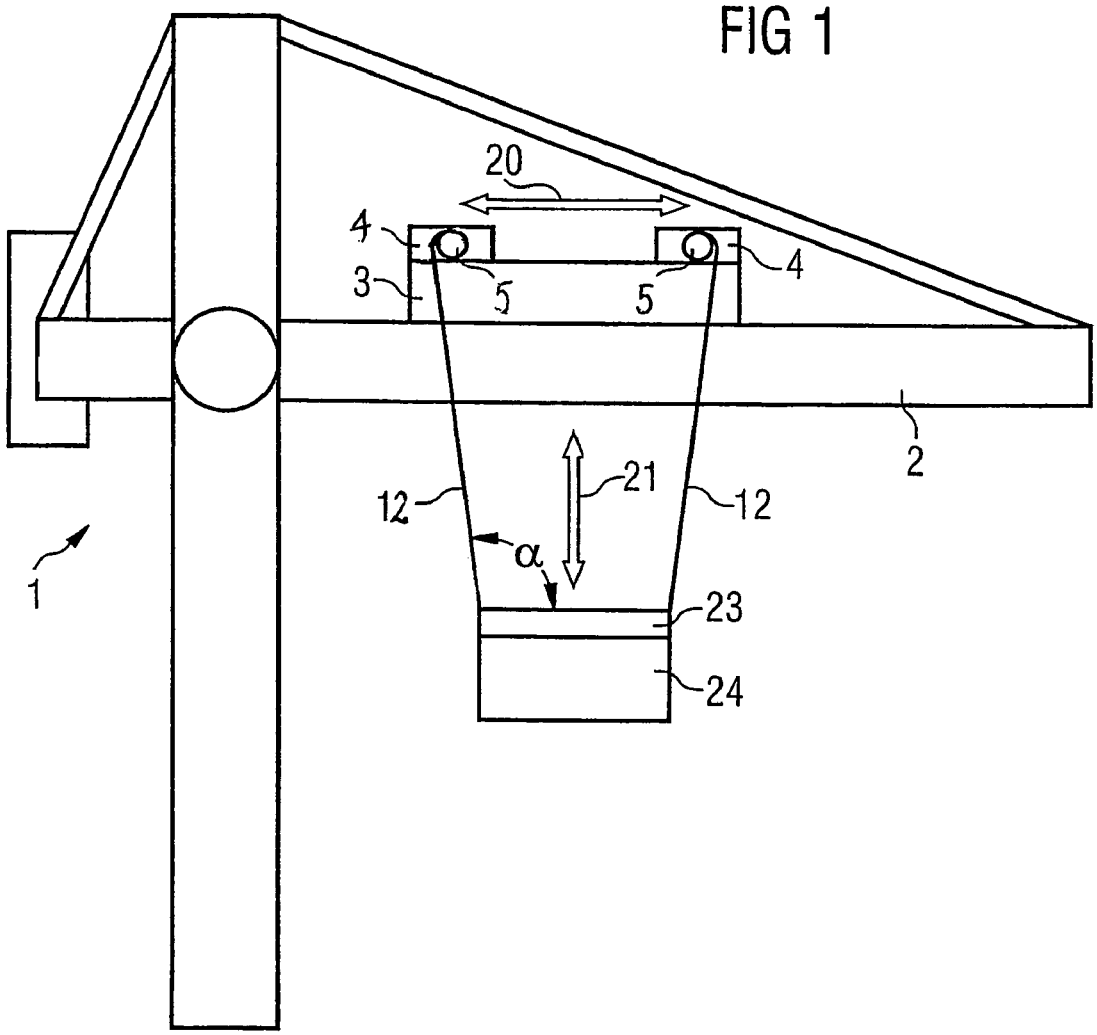
FIG. 1 shows a schematic side view of an exemplary crane having incorporated therein the subject matter of the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

This is one of three applications, all filed on the same day. These applications deal with related inventions. They are commonly owned and have same or different inventive entities. These applications are unique, but incorporate the others by reference. Accordingly, the following U.S. patent application is hereby expressly incorporated by reference: "METHOD AND DEVICE FOR DETERMINING A SWINGING MOTION OF A LOAD SUSPENDED FROM A LIFTING GEAR" by co-inventors Peter Schulte, Peter Maurer, and Ingbert Strebel, and "METHOD AND DEVICE FOR RECOGNITION OF A LOAD ON A LIFTING GEAR", by co-inventors Peter Maurer, Peter Schulte, and Ingbert Strebel.

Turning now to the drawing, and in particular to FIG. 1, there is shown a there is shown a side view a schematic illustration of a crane generally designated by reference numeral 1. The crane 1 includes a boom 2 and a trolley 3 movable along the boom 2 in a travel direction, as indicated by a double arrow 20. The trolley 3 includes a hoist mechanism for lifting or lowering a load 24 in a direction, as indicated by a double arrow 21. In the non-limiting example of FIG. 1, the load 24 is mounted to a load-carrying member 23, for example a spreader or gripper assembly for a container. The hoist mechanism has four lifting units 4, with each of the lifting units 4 equipped with a cable drum 5. In the illustration of FIG. 1, only two of the four lifting units 4 are visible, with the other lifting units 4 obscured from view. Each cable drum 5 receives a rope or cable 12 and is operatively connected with its own drive unit 16, e.g. an electric machine or electric motor. As the cable drum 5 rotates, the cable 12 pays our or is taken in, depending on the operation of the drive unit 16.

The cables 12 extend at a slant or inclination in relation to the lifting direction 21 toward the load-carrying member 23. The trolley 3 has a longitudinal dimension which is greater than the load 24 so that the two cables 12 on either side of the load-carrying member 23 describe a trapezoidal configuration and define a suspension angle $\alpha$ of greater than 90 degrees with respect to the transverse side of the load-carrying member 23. Of course, it is equally applicable to attach the cables 12 in a trapezoidal configuration on the longitudinal side of the load-carrying member 23. The suspension angle $\alpha$ thus is described between each cable 12 and the load 24.

Figure 2:
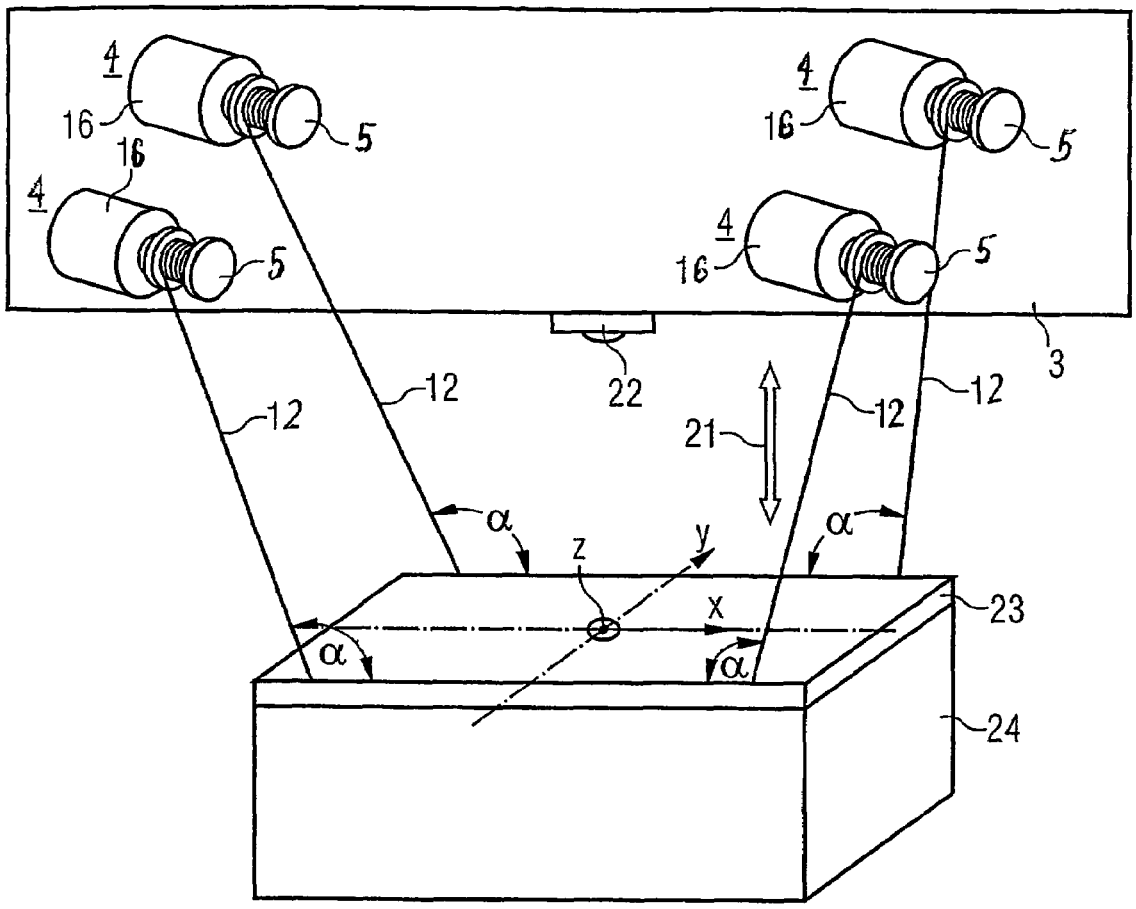
FIG. 2 is a schematic illustration of a trolley of the crane with suspended load.

FIG. 2 shows by way of example the arrangement of the four lifting units 4 and the four cable drums 5, with each cable drum 5 having its own drive unit 16. The lifting units 4 are disposed in corner areas of the trolley 3 in order to lift and lower the load-carrying member 23 with attached load 24. For sake of simplicity, the following description relates to load 24 only, even though the load is attached to the load-carrying member 23 in the example of FIGS. 1 and 2. The lifting units 4 are located in a single plane. Of course, this configuration is shown by way of example only, and other configurations which generally follow the concepts outlined here are considered to be covered by this disclosure as well. As described above, the cable drums 5 are connected to the load 24 via the cables 12, whereby the cables 12 extend at a slant in relation to the lifting direction at the suspension angle $\alpha$ of greater than 90 degrees.

Attached to the trolley 3 is a detection device 22 for recognizing the position of the load 24. The detection device 22 may be realized in the form of optic or acoustic measuring devices or other types of measuring devices known to the artisan that are suitable for position recognition. Indicated on the load-carrying member 23 for ease of understanding is a coordinate system with x-axis, y-axis, and z-axis which extends perpendicular to the x- and y-axes in the lifting direction 21. As the trolley 3 moves in a direction of at least one of the axes x, y, z, the load 24 may be caused to swing. The detection device 22 monitors the position of the load 23 and determines possible swing. When a swing of the load 24 is recognized, the detection device 22 instructs one or more of the drive units 16 to rotate the associated cable drum or drums 5 to rotate in a desired direction and to thereby change the length of one or more of the cables 12. As a result, a slack in one cable 12 can be counteracted to make the cable 12 taut again. The change in tension of a cable 12 can be ascertained, for example, by the torque to be applied by the electric motor of the associated drive unit 16. As a consequence of the compensation, elimination and/or prevention of a swinging motion, the load 24 can be maintained in correct position. Thus, the load 24 can be deposited as well as picked up by the load-carrying member 23 accurately and quickly. The cargo transfer is safe and is executed quickly and precisely. Moreover, the crane 1 is able to maintain the load 24 in a horizontal disposition at any time, as a result of the suspension by means of four cables 12 and proper adjustment of the cable lengths.

Figure 3:
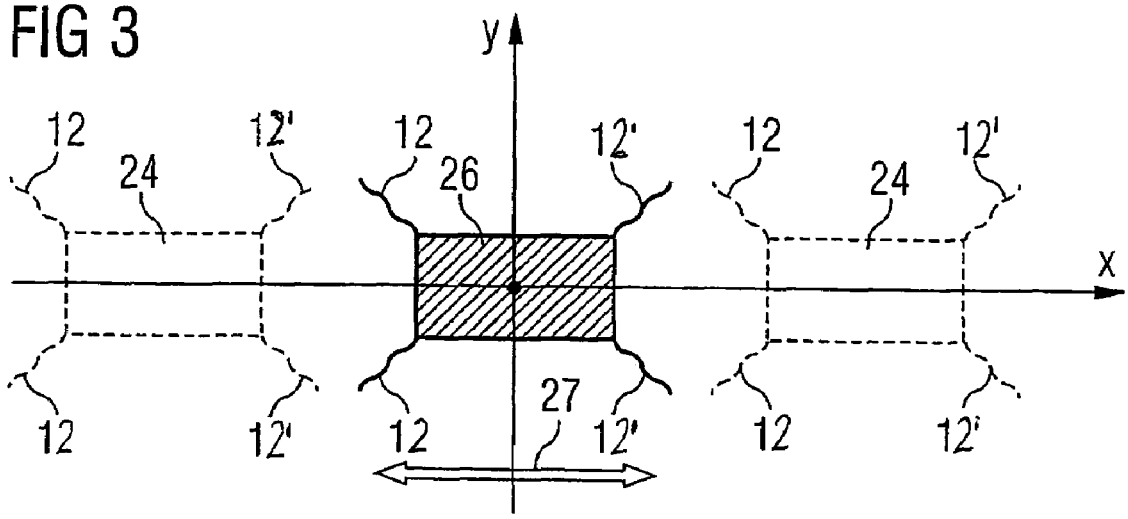
FIG. 3 is a schematic illustration of a swinging motion of a load in x-direction.
Figure 4:
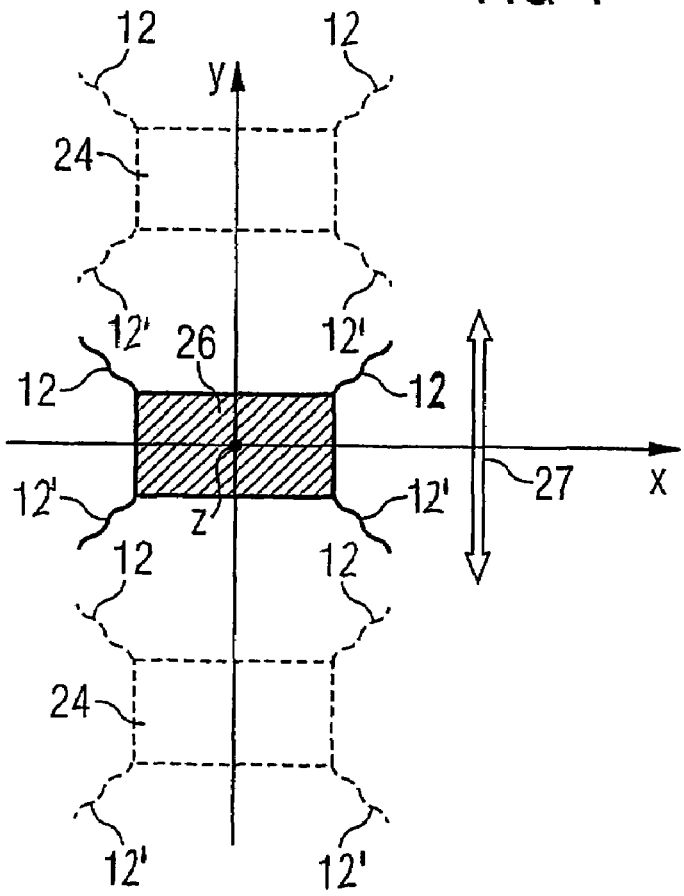
FIG. 4 is a schematic illustration of a swinging motion of a load in y-direction.
Figure 5:
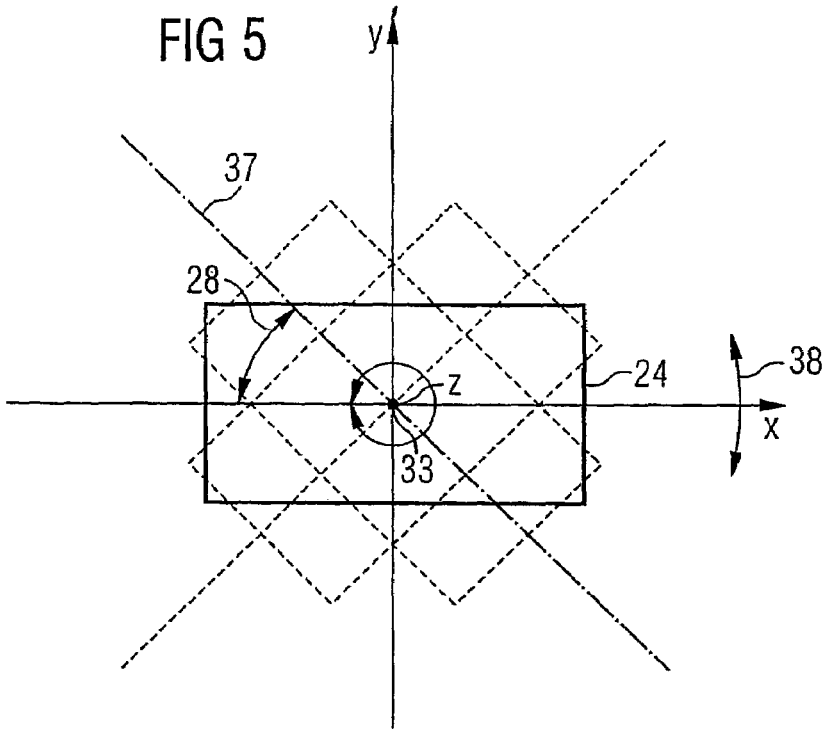
FIG. 5 is a schematic illustration of a swinging motion about a rotation point which coincides with a z-axis.

FIGS. 3 to 5 show plan views of schematic illustrations of possible swinging motions. Depicted is a Cartesian coordinate system with x-axis, y-axis and z-axis which extends perpendicular to the x- and y-axes and is shown here only by a dot as a consequence of the plan view. The zero point of the coordinate system coincides in the examples of FIGS. 3 to 5 with the center of the load 24. The serpentine lines represent the cables 12.

FIG. 3 shows a swinging motion in a positive and negative x-direction, as indicated by double arrow 27. As the load 24 swings in x-direction, it is deflected from the rest position which is shown by the hatched box 26. As a consequence, the load 24 is out of plumb and thus no longer in the horizontal disposition. To counteract and eliminate the swinging motion and thus the slanted alignment of the load 24, the detector device 22 is activated to change the length of one or more cables 12. To return the load 24 to the horizontal disposition, when the load 24 swing in x-direction, the parallel cables 12 on one transverse side of the load-carrying member 23 (FIG. 2) and/or the two cables 12' on the other transverse side thereof are lengthened or shortened, respectively.

FIG. 4 shows a swinging motion in y-direction, i.e. in a direction perpendicular to the x-axis. The rest position of the load 24 is again illustrated by the hatched box 26 and the swinging motion is depicted by double arrow 27. A swinging in y-direction also causes the load 24 to assume a slanted disposition which is counteracted through respective change in length of the cables 12. In order to return the load 24 to the horizontal disposition, the two parallel cables 12 on one of the long sides of the load-carrying member 23 and/or the two parallel cables 12' on the other one of the long sides thereof are lengthened or shortened, respectively.

FIG. 5 depicts an exaggerated swinging motion about a rotation point 33 which coincides with the z-axis and thus, e.g., with the load center. The gravity center of the load 24 may also coincide with the rotation point 33. The angle $\alpha$ between the x-axis and a centerline 37 through the load 24 defines the rotation angle, i.e., the skew angle 28. The rotation motion about the z-axis is indicated by the curved double arrow 38. Compensation of this swinging motion again is implemented by shortening or lengthening the length of cables 12 (not shown here).

As described above, a load 24, e.g. a container, suspended from the cables 12 has a tendency to swing or wobble (skew). The skew angle 28 can, e.g., be ascertained by two unillustrated camera systems with infrared searchlights and infrared reflectors. The use of four cable drums 5 with separate drive units 16 allows compensation of the skew angle, and there is no need to wait for a cessation of the load swing, before a load can be deposited. As a result, the operational safety is enhanced because of the calm and steady behavior of the load 24, on one hand, and the transfer of loads 24 can be executed quickly, on the other hand because of the absence of any waiting periods. The provision of four separate drive units 16 for the four cable drums 5 is easy to implement and not labor-intensive or costly.

Figure 6:
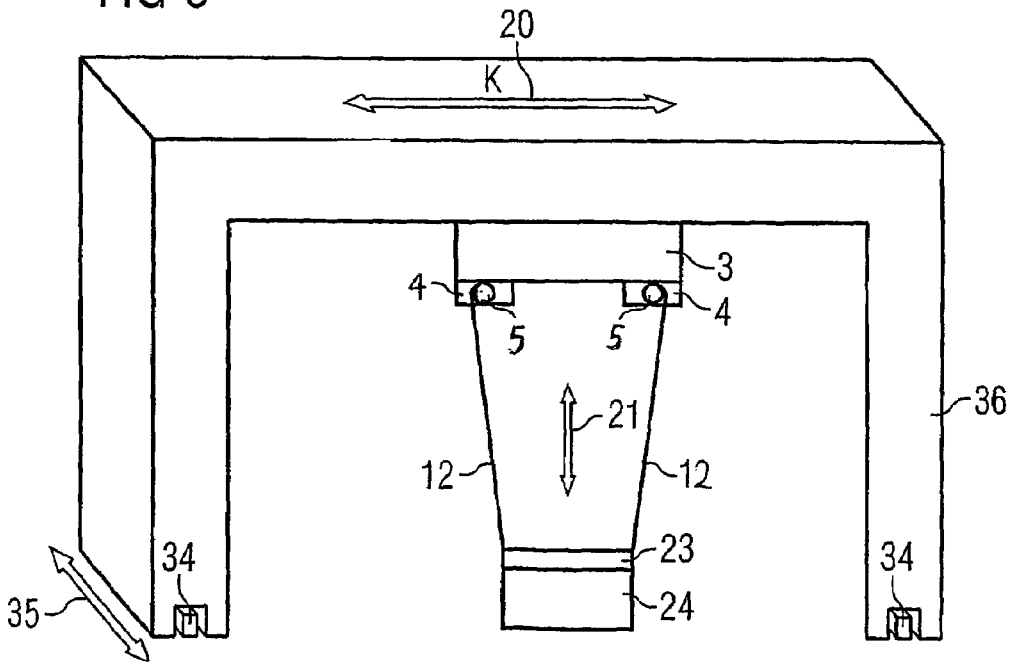
FIG. 6 is a schematic illustration of an exemplary gantry having incorporated therein the subject matter of the present invention.

FIG. 6 shows a side view of another exemplary lifting gear, such as a gantry 36, also called container bridge, for loading and unloading containers and having incorporated the subject matter of the present invention. The gantry 36 includes a trolley 3 and a hoist mechanism for lifting a load 24. Parts corresponding with those in FIG. 1 are denoted by identical reference numerals. The hoist mechanism includes four lifting units 4, each equipped with a cable drum 5, whereby again only two of the four lifting units 4 are visible in FIG. 6. While FIG. 6 shows the gantry 36 movable along a rail 34 in a travel direction indicated by double arrow 35, it is, of course, also conceivable to construct a mobility of the gantry 36 without rails. As the trolley 3 and/or the gantry 36 travel and as the load 24 or the load-carrying member 23 is lifted and lowered in lifting direction 21, also the gantry 36 may encounter a swinging of the load 24 and/or the load-carrying member 23. The swinging motion can again be compensated or eliminated by changing one or more cable lengths, and to maintain the load 24 in a horizontal disposition.

Figure 7:
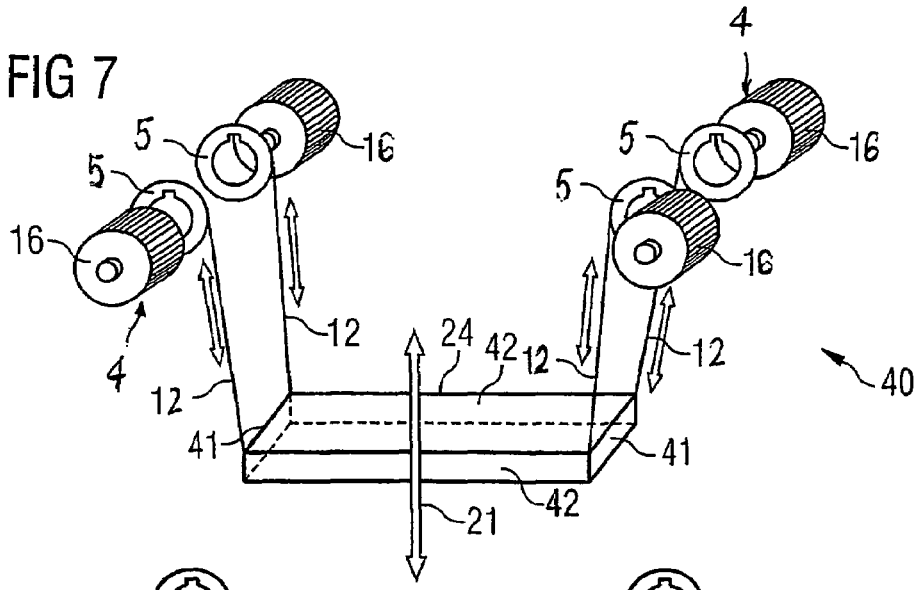
FIG. 7 is a schematic perspective illustration of a suspension of a load through transverse guying.
Figure 7A:
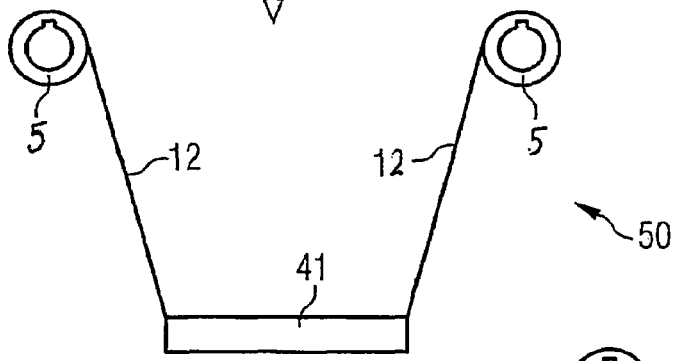
FIG. 7*a* is a schematic illustration of the load suspension as viewed from a transverse side.
Figure 7B:
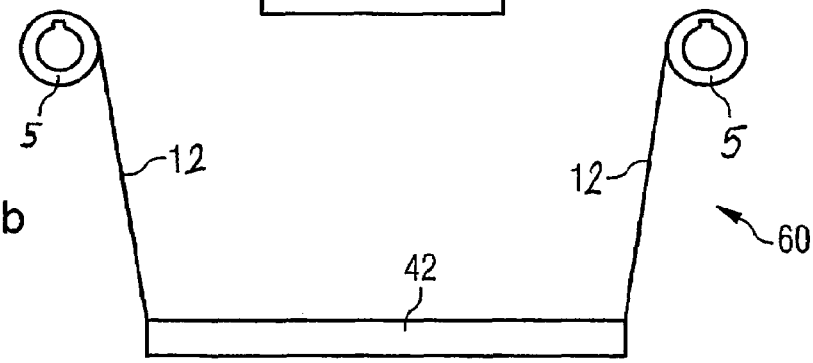
FIG. 7*b* is a schematic illustration of the load suspension as viewed from a long side.

Referring now to FIG. 7, there is shown a perspective view of a load suspension, generally labeled to by reference numeral 40, for supporting a load 24 with four individually operated cable drums 5, each driven by its own drive unit 16. The cables 12 between the lifting units 4 and the load 24 extend slantingly in relation to the lifting direction 21. As a result of the individual operation of the cable drums 5, it is possible to individually lift or lower each corner of the load 24 or transverse side 41 or longitudinal side 42 to thereby adjust or control the skew angle. FIG. 7*a* shows a load suspension 50 at a transverse side 41, and FIG. 7*b* shows a load suspension 60 at a long side 42 of the load to more clearly illustrate transverse guying.

Figure 8:
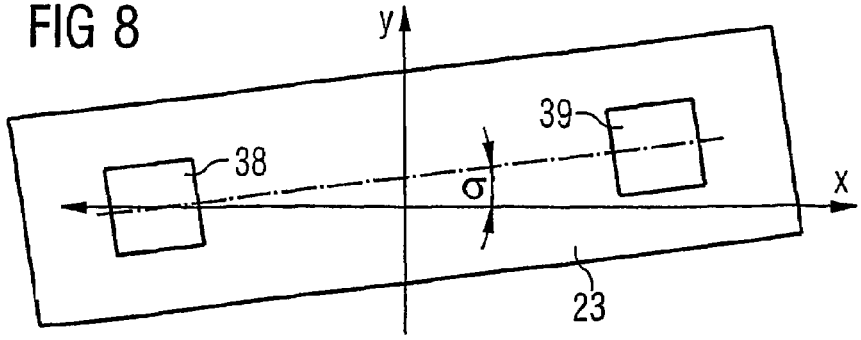
FIG. 8 is a schematic plan view of a load-carrying member in cooperation with a position determination device for ascertaining another type of swinging motion of a load.

FIG. 8 shows a plan view of a load-carrying member 23 which includes two markers 38, 39 for determination of the position of the load-carrying member 23 by using a device for position determination. The device for position determination includes, for example, an unillustrated camera for recording the position of the markers 38, 39. In the illustration of FIG. 8, the load-carrying member 23 with an unillustrated load undergoes a skewing motion about the marker 38 at a skew angle a. Compensation the skewing motion again involves length adjustment of appropriate cables 12. The markers 38, 39 may, e.g., be represented by reflectors for infrared light.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method for controlling a position of a load on a lifting gear, comprising the steps of:

determining a position of a load suspended from a trolley of a lifting gear via at least four cables which hold the load and terminate at four separate locations on the load; and counteracting a swinging motion of the load by operatively connecting each of the four cables with a separate drive and selectively operating the drives to selectively adjust the length of the cables, wherein the counteracting step includes the steps of automatically ascertaining a change in tension of a cable as a result of a change in torque applied by an electric motor of the drive associated to the cable, and operating at least one of the drives in response to the change in tension of the cable to make the cable taut again.

2. The method of claim 1, wherein the drive of the cable is operated to shorten the length of the cable.

3. The method of claim 2, wherein the drives of two of the cables are operated to shorten the length of the cable.

4. The method of claim 1, wherein the drives of two other ones of the cables are operated to lengthen the cables.

5. The method of claim 4, wherein the drives of three other ones of the cables are operated to lengthen the cables.

6. The method of claim 1, wherein the drives of two diagonally oppositely disposed cable are operated to lengthen or shorten the two diagonally oppositely disposed cables.

7. The method of claim 1, wherein the counteracting step includes the step of selectively paying out or taking in the cables to maintain a horizontal position of the load during lifting, lowering or swinging motions.

8. The method of claim 1, wherein the load is defined by a skew angle between an x-axis and a centerline through the load, when out of plumb, said skew angle being influenced by changing the length of at least one of the cables.

9. A device for controlling a position of a load on a lifting gear, comprising:

a trolley;

a hoisting mechanism including at least four lifting units for suspending a load at four separate locations, each lifting unit having a cable drum which receives a cable terminating at a corresponding one of the four locations for connection to the load, and a separate drive unit operatively connected to the cable drum for adjusting a length of the cable so that a swinging motion of the load can be counteracted through selective operation of the drive units and accompanying change in length of pertaining cables and a detection system for recognizing a change in tension of a cable as a result of a change in torque applied by an electric motor of the drive associated to the cable and controlling a position of the load by operating at least one of the drives in response to the change in tension of the cable to make the cable taut again, wherein the detection system and the drive units of the lifting units are constructed for automatic operation.

10. The device of claim 9, wherein the cables extend between the load-carrying member and the lifting units at a slant in relation to a lifting direction of the load.

11. The device of claim 10, wherein the slant of the cable between the load-carrying member and the lifting units is greater than 90°.

12. The device of claim 9, wherein the drive units are constructed such that each of the drive units can be controlled and regulated individually.

13. The device of claim 9, wherein the drive unit includes an electric motor.

* * * * *